US009017604B2

(12) United States Patent
Lyon et al.

(10) Patent No.: US 9,017,604 B2
(45) Date of Patent: Apr. 28, 2015

(54) MAGNESIUM ALLOYS CONTAINING RARE EARTHS

(75) Inventors: Paul Lyon, Bolton (GB); Ismet Syed, Romiley (GB); Anthony James Boden, Oxspring (GB); Kenneth Savage, Bolton (GB)

(73) Assignee: Magnesium Elektron Limited, Salford (GB)

( * ) Notice: Subject to any disclaimer, the term of this patent is extended or adjusted under 35 U.S.C. 154(b) by 701 days.

(21) Appl. No.: 13/121,588

(22) PCT Filed: Sep. 30, 2009

(86) PCT No.: PCT/GB2009/002325

§ 371 (c)(1),
(2), (4) Date: May 19, 2011

(87) PCT Pub. No.: WO2010/038016

PCT Pub. Date: Apr. 8, 2010

(65) Prior Publication Data

US 2011/0229365 A1 Sep. 22, 2011

(30) Foreign Application Priority Data

Sep. 30, 2008 (GB) ..... 0817893.1

(51) Int. Cl.

| | |
|---|---|
| ***C22C 23/06*** | (2006.01) |
| ***C22C 23/04*** | (2006.01) |
| ***C22C 23/02*** | (2006.01) |
| ***C22C 23/00*** | (2006.01) |
| ***C22F 1/06*** | (2006.01) |
| ***C22C 1/02*** | (2006.01) |

(52) U.S. Cl.
CPC . *C22C 23/06* (2013.01); *C22F 1/06* (2013.01); *C22C 1/02* (2013.01)

(58) Field of Classification Search
None
See application file for complete search history.

(56) References Cited

U.S. PATENT DOCUMENTS

| | | | |
|---|---|---|---|
| 6,495,267 | B1 | 12/2002 | Schenkel |
| 2002/0104761 | A1 | 8/2002 | Birss et al. |

FOREIGN PATENT DOCUMENTS

| | | | | |
|---|---|---|---|---|
| CN | 101008060 | | 8/2007 | |
| CN | 101078080 | | 11/2007 | |
| FR | 2688233 | | 3/1992 | |
| GB | 2095288 | | 9/1982 | |
| JP | 09-104955 | * | 4/1997 | ..... C22F 1/06 |

(Continued)

OTHER PUBLICATIONS

English translation of JP 09-104955.*

(Continued)

*Primary Examiner* — Yoshitoshi Takeuchi
(74) *Attorney, Agent, or Firm* — Pearne & Gordon LLP

(57) ABSTRACT

Magnesium alloys containing: Y: 2.0-6.0% by weight Nd: 0-4.0% by weight Gd: 0-5.5% by weight Dy: 0-5.5% by weight Er: 0-5.5% by weight Zr: 0.05-1.0% by weight Zn+Mn: <0.11% by weight, optionally other rare earths and heavy rare earths, the balance being magnesium and incidental impurities and the total content of Gd, Dy and Er is in the range of 0.3-12% by weight, wherein either the alloy contains low amounts of Yb and Sm and exhibits a corrosion rate as measured according to ASTM B 117 of less than 30 Mpy, and/or the area percentage of any precipitated particles arising when the alloy is processed having an average particle size greater than 1 [mu]m and less than 15 [mu]m is less than 3%.

20 Claims, 4 Drawing Sheets

(56) References Cited

FOREIGN PATENT DOCUMENTS

Figure 1:
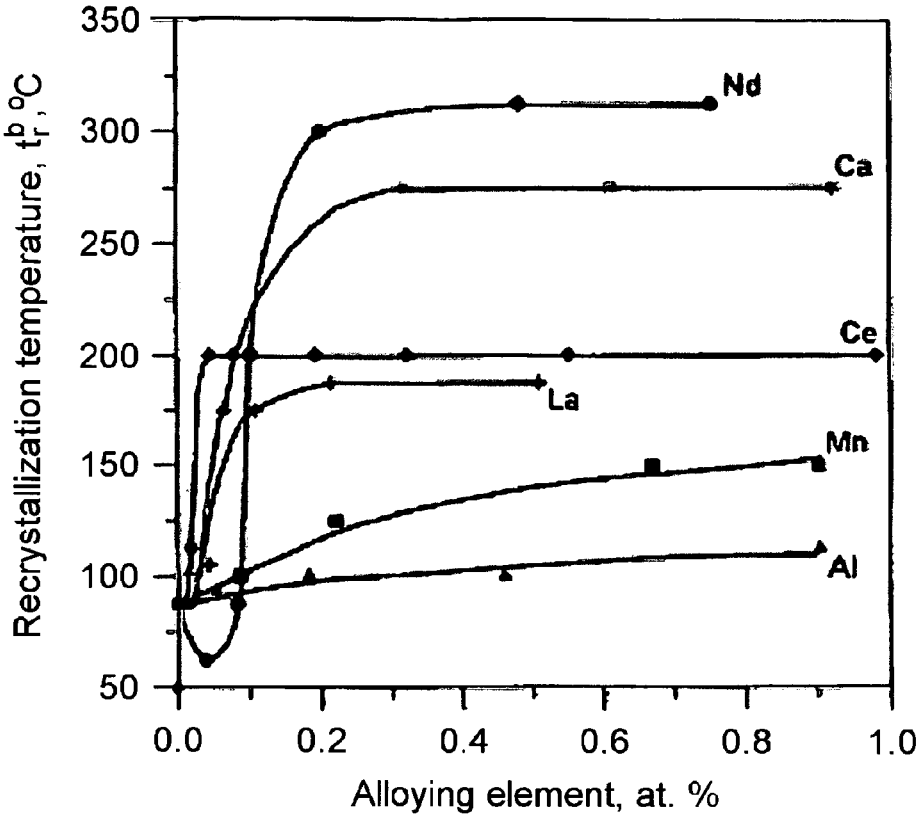

| | | |
|---|---|---|
| JP | 09263871 | 10/1997 |
| JP | 9104955 | 4/1998 |
| JP | 10147830 | 6/1998 |
| RU | 1360223 | 10/1994 |
| WO | 2008032087 | 3/2008 |

OTHER PUBLICATIONS

International Search Report for International Application No. PCT/GB2009/002325 completed on Feb. 16, 2010, and mailed on Feb. 23, 2010.

International Preliminary Report on Patentability for International Application No. PCT/GB2009/002325.

United Kingdom Search Report for Application No. GB0817893.1. Date of Search: Oct. 15, 2008.

Zhang et al., "Effect of Gd content on microstructure and mechanical properties of Mg—Y—Re—Zr alloys", Trans. Nonferrous Met. Soc. China 18(2008) s12-s16.

Marrow et al., "Environment-assisted cracking of cast WE43-T6 magnesium", Materials Science and Engineering A 387-389 (2004) 419-423.

Zhao et al., "Deformation behavior and dynamic recrystallization of Mg—Y—Nd—Gd—Zr alloy", Journal of Rare Earths, vol. 26, Issue 6, Dec. 2008, pp. 846-850.

* cited by examiner

MAGNESIUM ALLOYS CONTAINING RARE EARTHS

The present invention relates to magnesium alloys containing rare earths which possess improved processability and/or ductility, particularly when wrought, whilst retaining good corrosion resistance.

Rare earths can be divided according their mass between Rare Earths ("RE"—defined herein as Y, La, Ce, Pr and Nd) and Heavy Rare Earths ("HRE"—defined herein as the elements with atomic numbers between 62 and 71, i.e. Sm, Eu, Gd, Tb, Dy, Ho, Er, Tm, Yb and Lu). Collectively they are often referred to as RE/HRE. It is known, for example from GB-A-2095288, that the presence of RE/HRE provides magnesium alloys with good strength and creep resistance at elevated temperatures.

Magnesium-Yttrium-Neodymium-Heavy Rare Earth-Zirconium alloys (Mg—Y—Nd-HRE-Zr) are commercially available. Examples include those currently available under the trade marks Elektron WE43 and Elektron WE54 (hereinafter referred to as "WE43" and "WE54", respectively). WE43 and WE54 are designed for use from room temperature to 300° C. and it is known that these alloys can be used in both cast and wrought form. Their chemical composition, as defined by ASTM B107/B 107M06, is shown below in Table 1 (taken from ASTM B107/B). These known WE43 and WE54 alloys will hereinafter be referred to collectively as "WE43 type alloys"

elements such as yttrium and neodymium which create within the alloy strengthening precipitates. HRE are also present in these strengthening precipitates, which are Mg—Y-(HRE)-Nd compounds (ref. King, Lyon, Savage. 59$^{th}$ World Magnesium Conference, Montreal May 2002). According to GB-A-2095288 the HRE content of this type of alloy must be <40% of the yttrium content. Although pure Y can be used in the described alloy, in order to reduce the cost of the alloy, it is stated that a lower purity starting material can be used provided that the Y content is at least 60%. There is no recognition in this document of the significance of particular HREs, and it will be also noted that in the specific examples the use of Cd is encouraged. Furthermore, King et al (ref. King, Lyon, Savage. 59$^{th}$ World Magnesium Conference, Montreal May 2002) state that the ratio of Y/other RE (the RE component being principally HRE) should be typically be 80/20. This same reference also teaches that whilst the HRE component of WE43 type alloys is beneficial in teens of creep performance, high additions of RE such as Ce and La (i.e. of the order of 0.5 wt %) can be detrimental to the tensile properties of the alloy.

With a Y content of about 4% WE43 type alloys typically include around 1% HRE, which can contain Sm, Eu, Gd, Tb, Dy, Ho, Er, Yb and Lu and other REs such as La, Ce and Pr (ref. King, Lyon, Savage. 59$^{th}$ World Magnesium Conference, Montreal May 2002). The concentration of each of these individual elements is not specified in the literature, it merely being stated that "Other Rare Earths shall be principally heavy rare earths, for example Gd, Dy, Er, Yb" (Ref ASTM B107/B 107M06), or there is a reference to "Nd and other heavy rare earths" (ref BSI 3116:2007). Although these published data sheets for WE43 type alloys suggest that the

TABLE 1

| Alloy[B] | | Composition, % | | | | | | | | |
|---|---|---|---|---|---|---|---|---|---|---|
| UNS NO. | ASTM No. | Magnesium | Aluminium | Calcium | Copper | Iron | Lithium | Manganese | Neodymium | Nickel |
| M11311 | AZ31B | Remainder | 2.5-3.5 | 0.04 | 0.05 | 0.005 | | 0.20-1.0 | | 0.005 |
| M11312 | AZ31C | Remainder | 2.4-3.6 | | 0.10 | | | 0.15-1.0[D] | | 0.03 |
| M11610 | AZ61A | Remainder | 5.8-7.2 | | 0.05 | 0.005 | | 0.15-0.5 | | 0.005 |
| M11800 | AZ80A | Remainder | 7.8-9.2 | | 0.05 | 0.005 | | 0.12-0.5 | | 0.005 |
| M15100 | M1A | Remainder | | 0.30 | 0.05 | | | 1.2-2.0 | | 0.01 |
| M18432 | WE43B | Remainder | | | 0.02 | 0.010 | 0.2 | 0.03 | 2.0-2.5 | 0.005 |
| M18410 | WE54A | Remainder | | | 0.03 | | 0.2 | 0.03 | 1.5-2.0 | 0.005 |
| M16400 | ZK40A | Remainder | | | | | | | | |
| M16600 | ZK60A | Remainder | | | | | | | | |

| Alloy[B] | | Composition, % | | | | | | |
|---|---|---|---|---|---|---|---|---|
| UNS NO. | ASTM No. | Rare Earths | Silicon | Yttrium | Zirconium min | Zinc | Other Impurities, each | Total Other[C] Impurities |
| M11311 | AZ31B | | 0.10 | | | 0.6-1.4 | | 0.30 |
| M11312 | AZ31C | | 0.10 | | | 0.50-1.5 | | 0.30 |
| M11610 | AZ61A | | 0.10 | | | 0.40-1.5 | | 0.30 |
| M11800 | AZ80A | | 0.10 | | | 0.20-0.8 | | 0.30 |
| M15100 | M1A | | 0.10 | | | | | 0.30 |
| M18432 | WE43B | 1.9[E] | | 3.7-4.3 | 0.40-1.0 | [F] | 0.01 | |
| M18410 | WE54A | 2.0[E] | 0.01 | 4.75-5.5 | 0.40-1.0 | 0.20 | 0.2 | |
| M16400 | ZK40A | | | | 0.45 | 3.5-4.5 | | 0.30 |
| M16600 | ZK60A | | | | 0.45 | 4.8-6.2 | | 0.30 |

[A]Limits are in weight percent maximum unless shown as a range or otherwise stated
[B]These alloy designations were established in accordance with Practice B275 (see also Practice E527)
[C]Includes listed elements for which no specific limit is shown
[D]Manganese minimum limit need not be met if iron is 0.005% or less.
[E]Other Rare Earths shall be principally heavy rare earths, for example, Gadolinium, Dysprosium, Erbium and Ytterbium.
Other Rare Earths are derived from Yttrium, typically 80% Yttrium 20% heavy rare earths
[F]Zinc + Silver content shall not exceed 0.20% in WE43B For these WE43 type alloys their beneficial mechanical properties of good strength and creep resistance at elevated temperatures are achieved principally through the mechanism of precipitation hardening caused by the presence of levels of these "other rare earths" can be quite low, in practice the total concentration in such commercial alloys is around 20% of the total of the HRE plus Y present (ref Table 1 footnote e). So for a 4% Y containing WE43 alloy there would be around 1% "other Rare Earths". Within this amount of other Rare Earths, HREs other than Gd, Dy, Er, Yb and Sm are generally about 10-30% of the total content of Gd, Dy, Er, Yb and Sm in the alloy.

Mg—Y—Nd-HRE-Zr alloys such as WE43 type alloys were designed for applications at elevated temperatures (ref J Becker P15-28 Magnesium alloys and applications proceedings 1998 edited B. L Mordike). Strengthening precipitates containing Y/HRE and Nd are stable at elevated temperature and contribute to good tensile and creep performance. Whilst this strength and stability is of benefit for elevated temperature applications, this same characteristic can be of detriment during forming (wrought) operations. This is related to the alloys having limited formability and ductility. As a consequence, it is necessary to employ high processing temperatures, and low reduction rates (during hot forming operations) to minimise cracking. This adds to production cost and tends toward high scrap rates.

It has been discovered that by selecting and controlling certain types of RE/HRE within the Mg—Y—Nd-HRE-Zr type alloys unexpected benefits in processability and/or ductility of the material can be achieved, particularly when wrought, whilst retaining good corrosion resistance, without the need for any special heat treatment of the alloy.

Specifically, it has been found that the presence of the heavy rare earths Gd, Dy and Er in WE43 type alloys improve the alloy's processability and/or ductility, whereas the presence of other rare earths, particularly Yb and to a lesser extent Sm, tend to work against this improvement.

Further work then lead to an exploration of the behaviour of closely related yttrium-neodymium containing magnesium alloys and it has surprisingly been found that the above mentioned improvements in processability and/or ductility can also be found in certain of these alloys, even when Nd is almost completely absent.

In SU 1360223 magnesium-based alloys containing rare earths are described as having improved long-term strength and corrosion resistance by the essential incorporation thereinto of 0.1-2.5% by weight Zn and 0.01-0.05% by weight Mn. The ranges recited for Y, Gd, and Nd are broad and there is no recognition of the importance of the content of Gd in relation to the amount of Y in the alloy. Neither is there any recognition of the influence of other HREs. It is also apparent that the described alloy is intended for only cast applications and has been heat treated (T61).

Many prior art documents, such as U.S. Pat. No. 6,495,267, refer to the use of WE43 type alloys, without any mention of the importance of certain individual HREs. In JP 9-104955, for example, the heat treatment of WE43 type alloys is described in order to improve the ductility of the alloy. Because of the manufacturing process used to produce this type of commercial alloy the amount of HRE present will invariably be about 25% of the Y content of the alloy, Furthermore unspecified rare earths in addition to Gd, Dy and Er will be present in variable amounts, and in particular Yb will be present in an amount of at least 0.02% by weight. In contrast to the present invention the improved ductility asserted to have been obtained is described as having been achieved by a special heat treatment, which will inevitably increase production costs, rather than through the control of the alloy's composition.

The present invention seeks to provide improved alloys over WE43 type alloys in terms of their processability and/or ductility, whilst at the same time retaining equally good corrosion resistance. This latter is achieved by careful control of both known corrosion-causing impurities, particularly iron, nickel and copper, and also those alloying element which have been found for the present alloys to be detrimental to their corrosion behaviour, such as Zn and Mn. There are various interactions between the alloying components which affect the corrosion behaviour of the alloy of the present invention, but that behaviour should be no worse than WE43 type alloys. Using the standard salt fog test of ASTM B117 the alloys of the present invention should exhibit a corrosion rate of less than 30 Mpy.

In terms of their mechanical properties, in order to match the performance of WE43 type alloys, the alloys of the present invention, when intended to be used as wrought alloys, should have the following characteristics as measured in their as-extruded state at room temperature under the conditions described in the examples below:

0.2% YS>190 Mpa

UTS>280 Mpa

Elong>23%.

However for certain applications the alloys of the present invention may not need such high mechanical properties and lower values such as those defined by ASTM B107/B107M-07, or even the following, may well be sufficient:

0.2% YS>150 Mpa

UTS>240 Mpa

Elong>20%.

In addition to wrought applications, as with WE43 type alloys the alloys of the present invention are also useful as casting alloys.

Any subsequent processing of such casting alloys, such as heat treatment, will, of course, have a significant effect on the processability and ductility of the final material, and reduced tensile properties will generally only become manifest after such processing. Material in the F condition, ie. as extruded without any further heat treatment, can contain particles of a size that can cause a reduction in tensile properties in the material, particularly during subsequent processing. It has been found that for the alloys of the present invention an improvement in processability and/or ductility becomes noticeable when the area percentage of such particles formed either in the cast alloy when in the T4 or T6 condition, or in the wrought material in the F or aged (T5) condition or after any other processing, which are readily detectable by optical microscopy, ie. having an average particle size in the range of about 1 to 15 μm, is less than 3%, and particularly less than 1.5%. These optically resolvable particles tend to be brittle, and although their presence can be reduced through appropriated heat treatment, it is clearly preferable if their formation can be controlled by adjustment of the alloy's composition. Preferably the area percentage of particles having an average size greater than 1 and less than 7 μm is less than 3%.

Importantly the formation of these particles does not necessarily depend on the specific amounts of Yb and/or Sm present. It has been found that for material in the F condition the presence of these particles is often related to the relative proportion of the RE/HRE to Gd, Dy and Er, and not only the amounts of Yb and Sm in the alloy. For many alloys the total of rare earths (excluding Y and Nd) other than Gd, Dy and Er should be less than 20%, preferably less than 13% and more preferably less than 5%, of the total weight of Gd, Dy and Er.

The maximum content in the alloys of the present invention of the most unfavourable HREs, Yb and Sm, does to a certain extent depend on the particular alloy composition, but generally tensile properties will not be reduced significantly for wrought material if the Yb content is not greater than 0.02% by weight and the Sm content is not greater than 0.04% by weight. Preferably the Yb content is less than 0.01% by weight and the Sm content is less than 0.02% by weight.

For wrought applications in accordance with the present invention there is provided a magnesium alloy consisting of:

Y: 2.0-6.0% by weight
Nd: 0.05-4.0% by weight
Gd: 0-5.5% by weight
Dy: 0-5.5% by weight
Er: 0-5.5% by weight
Zr: 0.05-1.0% by weight
Zn+Mn: <0.11% by weight,
Yb: 0-0.02% by weight
Sm: 0-0.04% by weight,
optionally rare earths and heavy rare earths other than Y, Nd, Gd, Dy, Er, Yb and Sm in a total amount of up to 0.5% by weight, and the balance being magnesium and incidental impurities up to a total of 0.3% by weight, %, wherein
the total content of Gd, Dy and Er is in the range of 0.3-12% by weight, and
wherein the alloy exhibits a corrosion rate as measured according to ASTM B117 of less than 30 Mpy.

For casting applications in accordance with the present invention there is provided a magnesium alloy consisting of:

Y: 2.0-6.0% by weight
Nd: 0.05-4.0% by weight
Gd: 0-5.5% by weight
Dy: 0-5.5% by weight
Er: 0-5.5% by weight
Zr: 0.05-1.0% by weight
Zn+Mn: <0.11% by weight,
optionally rare earths and heavy rare earths other than Y, Nd, Gd, Dy and Er in a total amount of up to 20% by weight, and the balance being magnesium and incidental impurities up to a total of 0.3% by weight, wherein
the total content of Gd, Dy and Er is in the range of 0.3-12% by weight, and wherein when the alloy is in the T4 or T6 condition the area percentage of any precipitated particles having an average particle size of between 1 and 15 μm is less than 3%.

Preferably the cast alloy exhibits a corrosion rate as measured according to ASTM B117 of less than 30 Mpy.

Figure 3:
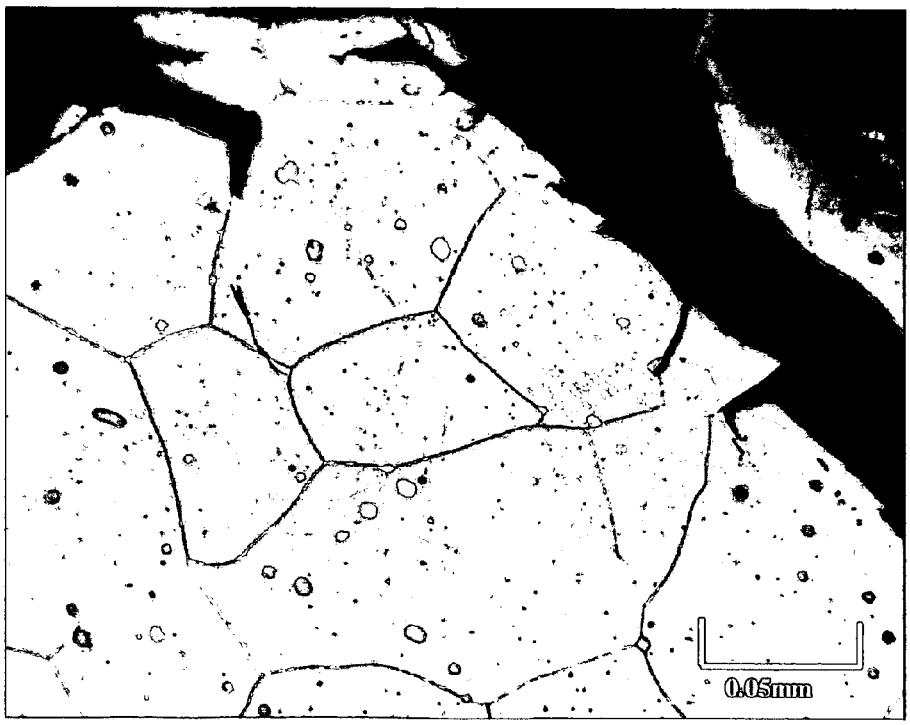
Figure 2A:
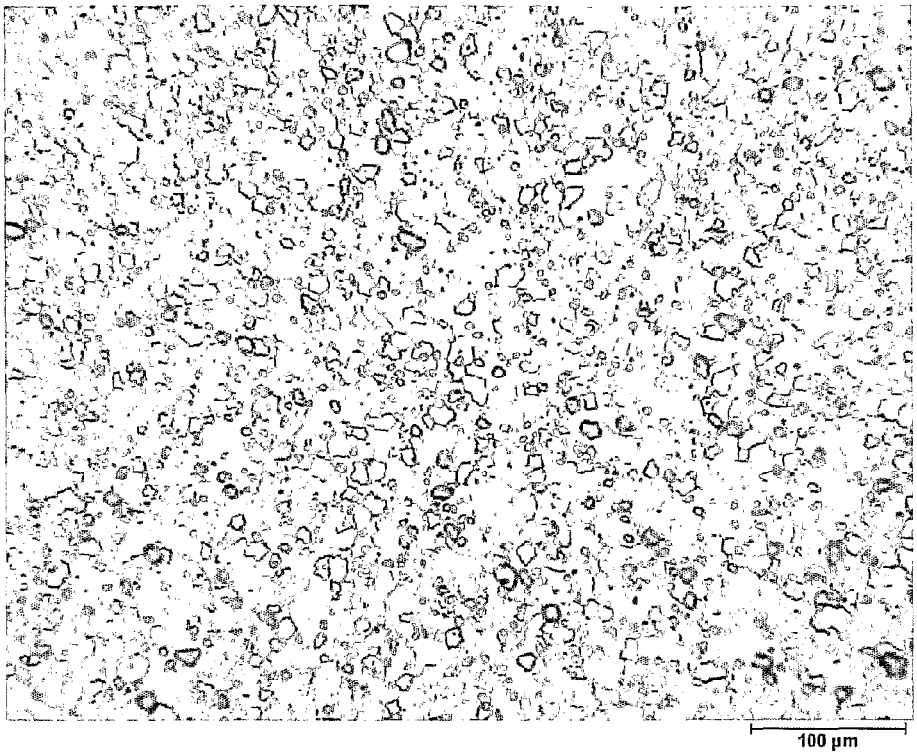
Figure 2B:
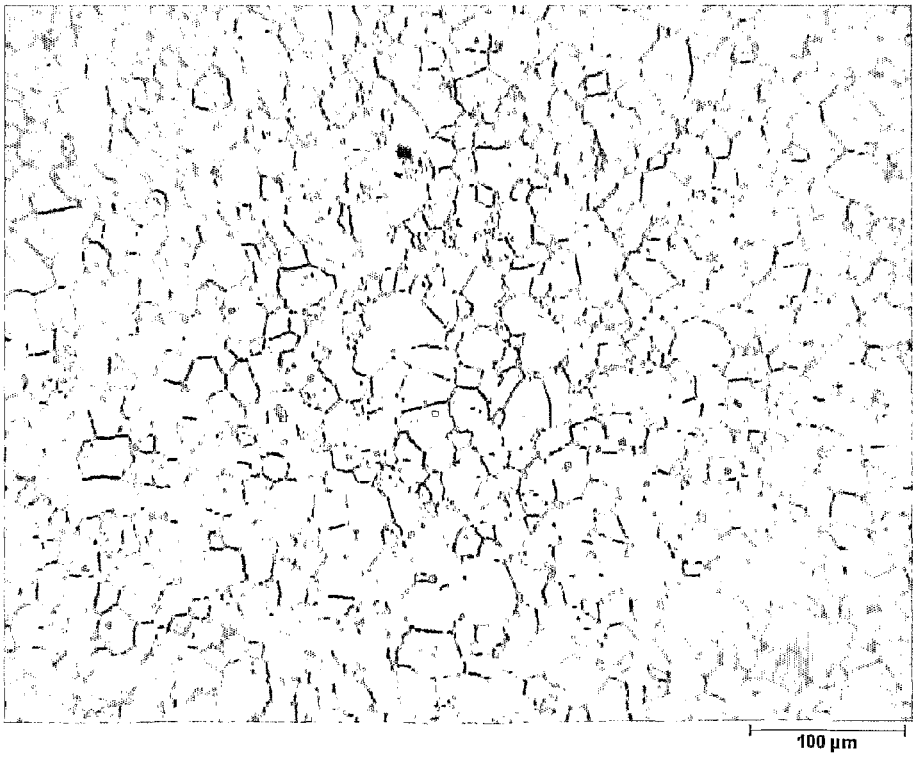
Figure 2C:
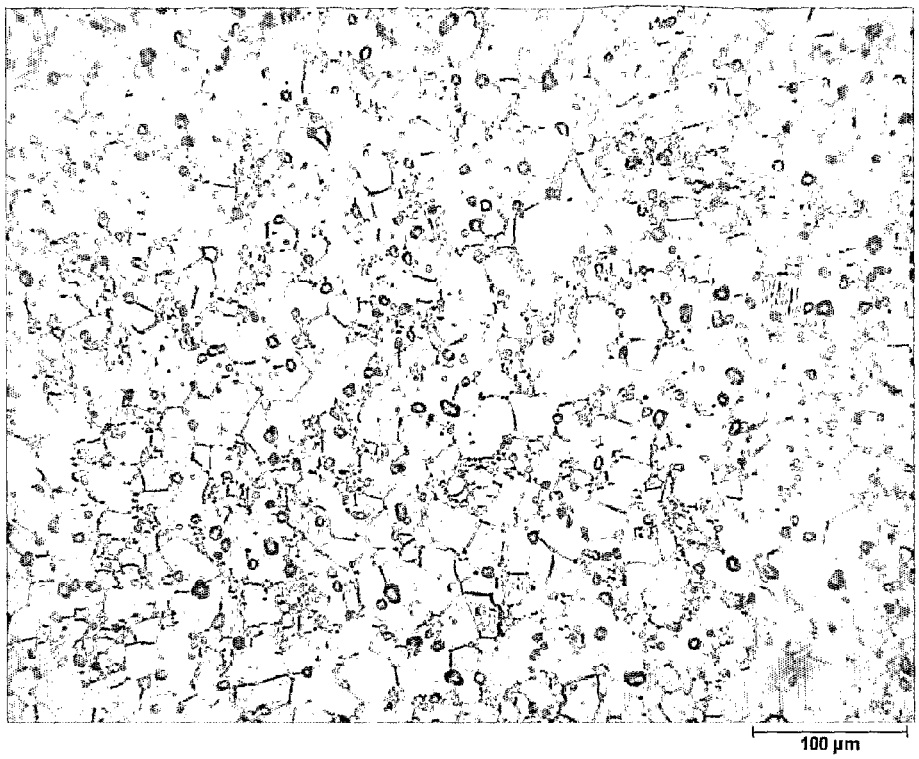
Figure 2D:
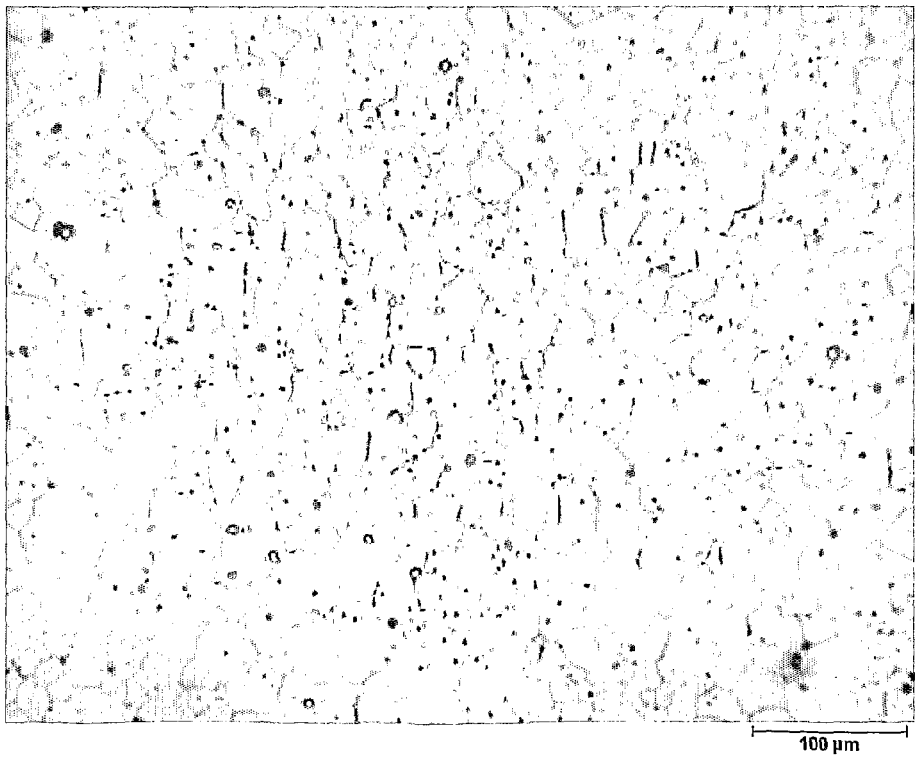
Figure 4A:
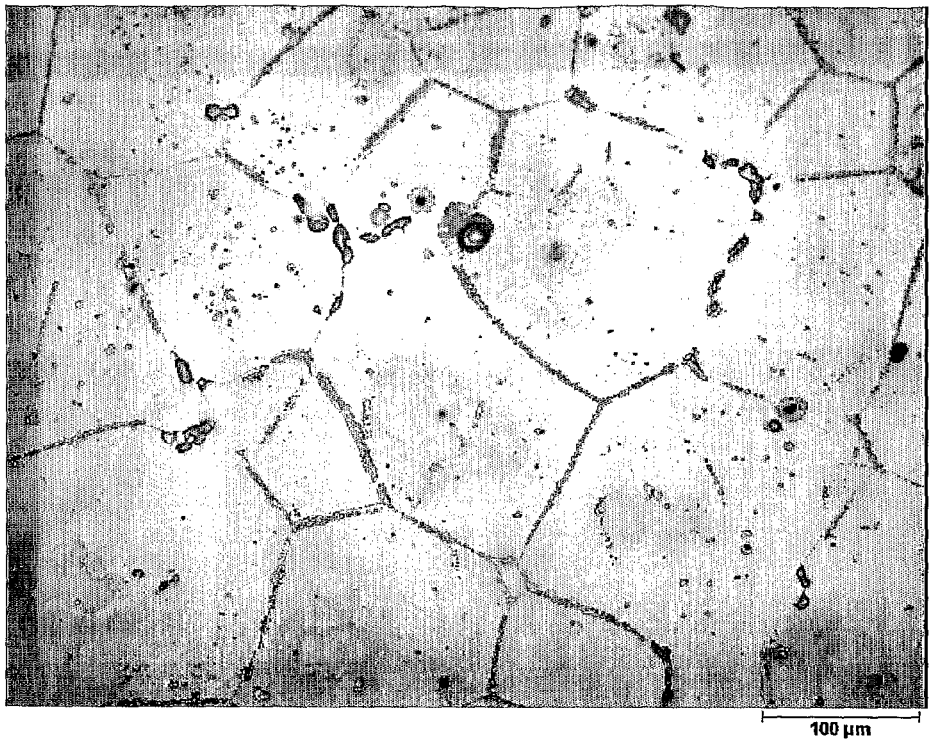
Figure 4B:
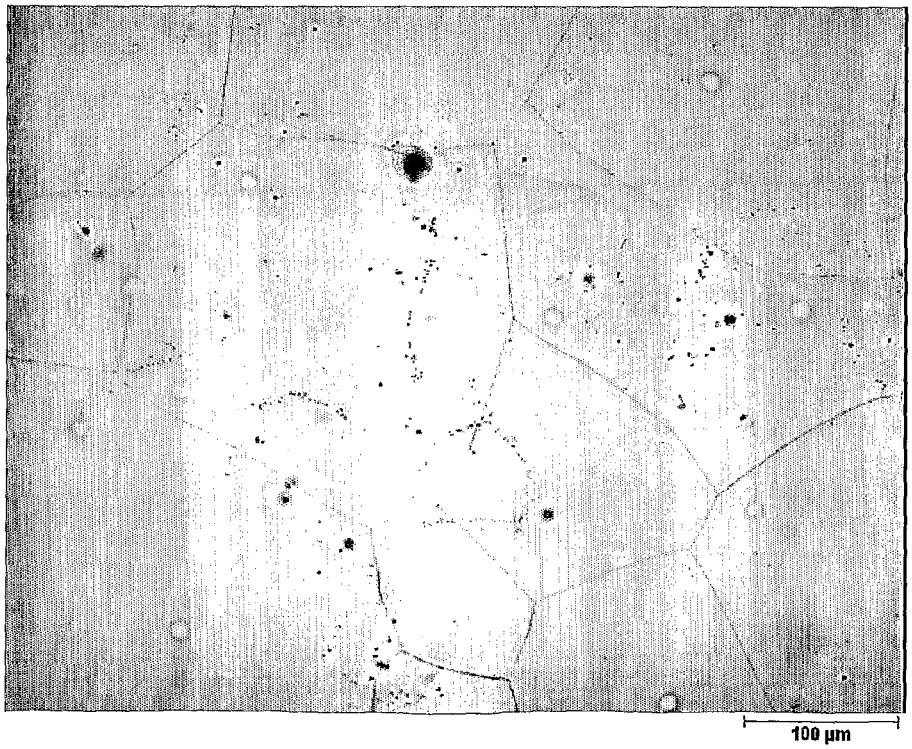

The present invention will now be described with reference to the accompanying drawings in which:

FIG. 1 is a graph showing the effect of alloying elements on the recrystallisation temperature of magnesium (taken from the latter mentioned Rokhlin 2003 reference), FIGS. 2A and 2C show the microstructures of two samples made from WE43 type alloys after extrusion at 450° C., the composition of the alloys being those of Sample 1a and Sample 1b of Table 3 below, respectively, FIGS. 2B and 2D show microstructures of two samples made from magnesium alloys of the present invention after extrusion at 450° C., the composition of the alloys being those of Sample 3d and Sample 3a of Table 3 below, respectively, FIG. 3 shows the microstructure of a sample of commercial wrought WE43 alloy which has failed under tensile load revealing in two areas cracks which are associated with the presence of brittle particles therein, FIGS. 4A and 4B are micrographs of two samples of sand cast alloys in the T4 condition, their compositions being Sample C and Sample D of Table 3 below, respectively.

Regarding processability an important mechanism is recrystallisation This is the ability to form new unstained grains and is beneficial in restoring ductility to material, which has been strained (for example, but not limited to, extrusion, rolling and drawing). Recrystallisation allows material to be re-strained to achieve further deformation. Recrystallisation is often achieved by heating the alloy (annealing) between processing steps.

If the temperature at which recrystallisation takes place or the time taken to complete recrystallisation can be lowered then the number and/or time of elevated temperature annealing steps can be reduced, and the forming (processing) of the material can be improved.

It is well recognised that one of the factors which affects recrystallisation is the purity of the material (ref Modern Physical Metallurgy—R E Smallman Third edition p 393), an example being the effect of copper content in aluminium alloys compared with zone refined (cleaned) aluminium.

It may be expected therefore that improving the purity of Mg—Y—Nd-HRE-Zr alloys, by, for example, reducing the levels of RE/HRE would reduce the recrystallisation temperature of the alloys. Indeed, for magnesium RE containing alloys, it has been reported (L. L. Rokhlin "Magnesium alloys containing RE metals" Taylor & Francis 2003 p 143) that REs increase the recrystallisation temperature of such alloys. This fact is related—according to Rokhlin and another researcher Drits—to increased activation energy of recrystallisation. Furthermore, Rokhlin (p 144) observed that the recrystallisation temperature is increased in correspondence with the solubility of the RE in magnesium; i.e. the more soluble the RE the higher the recrystallisation temperature. An exception is with small additions of RE, where the recrystallisation temperature is unaffected (viz. below about 0.05 atomic % according to accompanying FIG. 1).

Lorimer (Materials Science Forum Vols. 488-489 2005 pp 99-102) proposes that in WE43 type alloys recrystallisation can occur at second phase particles and that Particle Stimulated Nucleation (PSN) is a mechanism of recrystallisation.

From the above it can be concluded that the direction of teaching for Mg—Y—Nd-HRE-Zr type alloys is that, whilst the generation of HRE/RE particles could be beneficial to recrystallisation, increasing the RE/HRE content (particularly soluble RE/HRE) beyond about 0.05% by atomic weight will increase the recrystallisation temperature.

In contrast to that teaching however it has surprisingly been found that for Mg—Y—Nd-HRE-Zr alloys their recrystallisation behaviour during heat treatment can be improved by control of the HREs present, despite their significant content in the alloy. In other words by means of compositional control rather than by the use of special processing the recrystallisation behaviour of the alloy of the present invention can be improved, i.e. a heat treatment at lower temperature is sufficient for recrystallisation and/or less time is needed for complete recrystallisation than for WE43 type alloys. The use of the inventive magnesium alloy has thus an advantage in terms of processability and is more economical in terms of reduced processing time and reduced scrap, and can also improve the mechanical and corrosion properties of the alloy.

Examination of the microstructures of the inventive magnesium alloys and of WE43 type alloys reveal that after several deformation steps and subsequent intermediate heat treatments there were significantly fewer and smaller brittle precipitates (optically resolvable particles) in the inventive magnesium alloys than in WE43 type alloys processed in exactly the same way. In other words, the selection of the type and amount of REs and HREs present in Mg—Y—Nd-HRE-Zr alloys has surprisingly led to an improvement in the formability of the alloys.

Although particles in these alloys can arise from the interactions of any of their constituent elements, of particular interest to this invention are those particles which are formed from HRE/RE constituents. WE43 type alloys typically contain 1% HRE, which can consist of Gd, Dy, Er, Yb, Eu, Tb, Ho and Lu and other REs such as La, Ce and Pr. It has been discovered that by removing selective RE and HRE from a WE43 type alloy, without reducing the overall HRE content of the alloy, the occurrence and size of such particles is reduced. As a result the alloy's ductility can be improved and its recrystallisation temperature and/or recrystallisation time may be reduced, without significantly adversely affecting the alloy's tensile and corrosion properties, thus offering the opportunity to improve the forming processes applied to the alloy. In addition, it has been found that by control of the HRE components any grain growth in the alloy caused by these components is not significant enough to have a detrimental effect on the tensile properties of the alloy of the present invention.

As previously noted, Y and Nd, are the elements which improve the strength of the alloys to which the present invention relates by the mechanism of precipitation hardening. This relies on the fact that these alloy constituents are in a state of supersaturation and can subsequently be brought out of solution in a controlled manner during ageing (typically at temperatures in the range 200-250° C.). The precipitates desired for strength are small in size and these strengthening precipitates can not be resolved by optical microscopy. In the casting and processing of alloys which also contain sufficient Nd additional precipitates are also generated which are coarse and readily observed by optical microscopy as particles. These are usually rich in Nd and have an average particle size of less than 15 μm and generally up to about 10 μm (see accompanying FIG. 2B). These coarse particles are brittle, and reduce the formability and ductility of the material as illustrated in accompanying FIG. 3. Typically, a particle rich in Nd has a percentage composition of Nd greater than the percentage composition of any other element in the particle.

The present invention seeks to reduce the occurrence of such coarse particles by controlling the alloying components which have been found to cause these particles to be formed. In the course of examining the causation of these undesirable particles an unexpected link with the solubility of these alloying elements has been found.

The solubility of RE/HRE in magnesium varies considerably (see Table 2 below).

TABLE 2

| Atomic number | Element | Solid solubility at various temperatures (weight %) 200° C. | 400° C. | 500° C. |
|---|---|---|---|---|
| 68 | Er | 16 | 23 | 28 |
| 66 | Dy | 10 | 17.8 | 22.5 |
| 64 | Gd | 3.8 | 11.5 | 19.2 |
| 70 | Yb | 2.5 | 4.8 | 8 |
| 62 | Sm | 0.4 | 1.8 | 4.3 |
| 58 | Ce | 0.04 | 0.08 | 0.26 |
| 59 | Pr | 0.01 | 0.2 | 0.6 |
| 60 | Nd | 0.08 | 0.7 | 2.2 |
| 57 | La | — | 0.01 | 0.03 |

(Ref LL. Rokhlin "Magnesium alloys containing RE metals" Taylor & Francis 2003 p18-64)

From consideration of the data of each HRE/RE in Table 2 and the typical analysis of WE43 type alloys, it maybe be expected by one skilled in the art, that the volume of coarse particles present in such alloys would be primarily related to the alloy's Nd content due to the low solid solubility of this element.

It has been discovered however that by restricting the choice of RE/HRE components to Gd, Dy or Er or a mixture of these three elements, the volume of coarse Nd rich particles is significantly reduced. (See accompanying FIG. 2A vs 2B). This is unexpected, particularly when one considers that because of the solubility of other RE/HREs such as Yb and Sm it would be expected that those elements would be retained in solution and not contribute to the formation of coarse particles. Only La is insoluble in the range of compositions explored and the quantity is very small. As such removal of these RE/HREs and their replacement with Gd and/or Dy and/or Er would not be expected to make a material difference to the quantity of coarse particles.

Furthermore it would have been expected from the solubility data of Table 2 that the respective effects of the presence in the alloy of Gd and of Yb would be similar. In practice it has surprisingly been found that, whilst Gd can be present in an amount up to 5.5% by weight, for wrought alloys Yb must not be present in an amount greater than about 0.02% by weight whilst for cast alloys Yb should be less than about 0.01% by weight, otherwise the ductility of the alloy is seriously reduced. For Sm the maximum level is about 0.04% by weight. for both wrought and cast alloys. It has also been found that the favourable HREs, Gd, Dy and Er behave similarly in the inventive alloys in regard to their effects on the formability and ductility of the alloys, and that therefore these HREs are essentially interchangeable.

Another notable feature of WE43 type alloys is their resistance to corrosion. It is well known that general corrosion of magnesium alloys is affected by contaminants such as iron, nickel, copper and cobalt (J Hillis, Corrosion Ch 7.2 p 470. Magnesium Technology, 2006 Edited Mordike). This is due to the large difference in electro potential between these elements and magnesium. In corrosive environments, micro galvanic cells are produced, which lead to corrosion.

The addition of REs to magnesium has been reported to have some effect on the corrosion of binary alloys. It has been reported that high levels (several wt %) of elements such as La, Ce and Pr are detrimental to corrosion performance. Rohklin states (L L. Rokhlin Magnesium alloys containing RE metals Taylor & Francis 2003 P205) that at "small contents" (undefined), lower rates of corrosion can be seen than the base magnesium to which they were added. There does not however appear to be any clear teaching, about the effect of changing small amounts (in the region of this patent application) of RE/HRE on the corrosion performance of magnesium alloys.

Surprisingly, it has been found that by selecting the RE/HRE content of Mg—Y—Nd-HRE-Zr alloys, the corrosion performance of the present alloys can be improved; for some by a factor of approximately four. This is found to occur without reducing the overall total RE/HRE content of these alloys.

The present invention achieves the above described benefits by the control of both unfavourable HREs/REs, particularly Yb, and favourable HREs, namely Gd and/or Dy and/or Er. This discovery would not be expected from the teaching of Rokhlin (a renowned researcher in magnesium technology of some five decades with specific focus on Mg—RE alloys), whereby low levels of RE/HRE were asserted not to affect the recrystallisation temperature of magnesium unless the levels are comparatively high, and the more soluble RE, were found to have a tendency to increase the recrystallisation temperature. (ref (L L. Rokhlin Magnesium alloys containing RE metals Taylor & Francis 2003 p 144 line 15). Furthermore, Professor Lorimer et al (Materials Science Forum Vols. 488-489 2005 pp 99-102) maintains Particle Stimulated Nucleated (PSN) as a mechanism for recrystallisation in the Mg—Y—Nd-HRE-Zr alloy WE43. Reduction of particles might therefore be expected to limit this mechanism, rather than aid recrystallisation. According to the present invention this reduction in particles achieved by reducing the less favourable HRE/RE is more than would be expected from the amounts of detrimental HRE/RE replaced by the more favourable ones within the compositional limits set out in the accompanying claims.

The benefits of the inventive alloys become most apparent when the alloy is wrought, eg by extrusion. Furthermore although the mechanical properties of the alloys of the present invention can be favourably altered by known heat treatments, the improved ductility achieved by the described control of the alloy's composition can be attained without the need for such heat treatments. The inventive alloys can be used in similar applications to those in which WE43 type alloys can be used. They can be cast and/or heat treated and/or wrought, as well as being suitable as base alloys for metal matrix composites.

Preferably, the content of Y in the inventive alloys is 3.5-4.5% by weight, more preferably 3.7-4.3% by weight. Keeping the content of Y within these preferred ranges ensures that the consistency of properties, e.g. scatter during tensile testing, is maintained. Too low a Y content leads to a reduction in strength, whilst too high a Y content leads to a fall in ductility.

Further, the content of Nd in the alloys is preferably 1.5-3.5% by weight, more preferably 2.0-3.0% by weight, most preferably 2.0-2.5% by weight. When the content of Nd is lowered beyond about 1.5% by weight, and especially below 0.05% by weight, the strength of the alloy starts to decrease significantly. However, when the content of Nd is raised above 4.0% by weight, the ductility of the alloy is deteriorated due to limited solubility of Nd in Mg.

For the essential desirable HREs, Gd, Dy and Er, there should be at least 0.3% in total for their presence to have a significant effect on the processability and/or ductility of the alloy. Generally each may be present in an amount up to 5.5% by weight, but their preferred range depends on their solubility in the particular alloy, since as the quantity and size of precipitated particles in the alloy increases so the alloy's ductility falls. In addition, the relative amount of these desirable HREs compared to other HREs is important, since it has been found that for undesirable HREs, such as Yb and Sm, their effect on particularly the alloy's ductility is disproportionate to their content. Consistent with WE43 type alloys it has been found that improvements in ductility and/or processability whilst retaining good mechanical properties become particularly noticeable when the total content of rare earths (excluding Y and Nd) other than Gd, Dy and Er is less than 20%, and preferably less than 13%, of the total weight of Gd, Dy and Er. For cast material particularly, Yb should be less than 0.01% by weight.

The total content of Gd, Dy and Er in the inventive alloys is preferably in the range of 0.4-4.0 by weight, and more preferably from 0.5 up to 1.0% by weight., especially up to but less than 0.6% by weight.

The total content of Nd, Gd, Dy and Er in the alloy is preferably in the range of 2.0-5.5% by weight. Within this range, maintenance of good ductility can be ensured.

For wrought alloys rare earths and heavy rare earths other than Y, Nd, Gd, Dy, Er, Yb and Sm can be present in a total amount of up to 0.5% by weight. For cast alloys rare earths and heavy rare earths other than Y, Nd, Gd, Dy and Er can be present in a total amount of up to 20%, and preferably up to 5% by weight. It is preferred that the total content of rare earths (excluding Y and Nd) other than Gd, Dy and Er is less than 5% of the total weight of Gd, Dy and Er.

Preferably, because of current relative costs the inventive magnesium alloy includes Gd and Dy, especially solely Gd.

The content of Zr is preferably 0.1-0.7% by weight, zirconium has a significant benefit of reducing the grain size of magnesium alloys, especially of the pre-extruded material, which improves the ductility of the alloy.

It has further been found that impurities of iron and nickel should be controlled. This can be achieved by the addition of zirconium and aluminium which combine with iron and nickel to form an insoluble compound. This compound is precipitated in the melting crucible and settles prior to casting [Emley et al., Principles of Magnesium Technology. Pergamon Press 1966, p. 126ff; Foerster, U.S. Pat. No. 3,869,281, 1975]. Thus Zr and Al can contribute to improved corrosion resistance. To ensure these effects the content of Zr should be at least 0.05% by weight while the content of Al should be less than 0.3% by weight in the final alloy, and preferably no more than 0.2% by weight. When Zr is near its lowest level, namely 0.05% by weight, corrosion test results tend to become erratic.

As with WE43 type alloys some small amounts of established alloying elements can be present, provided that there is no significant detrimental effect on the alloy's processability/ductility/corrosion performance. For example, the inventive magnesium alloy can include less than 0.2% and preferably less than 0.02% by weight of Li, but should not contain more than 0.11% in total of Zn and Mn.

The total content of impurities in the alloy should be less than 0.3% by weight, and preferably less that 0.2% by weight. In particular, the following maximum impurity levels should be preserved:

Ce, Sm, La, Zn, Fe, Si, Cu, Ag, Cd: each individually 0.06% by weight

Ni: 0.003% by weight

Overall it is preferred that the inventive alloy comprise at least 91% by weight Mg.

The present invention will now be illustrated with reference to the following non-limiting examples. Samples were prepared both with and without extrusion having the compositions as set out in sections a and b of Table 3 below.

Several melts with different alloy compositions were melted and cast, extruded and were subject to different investigation with the emphasis on the microstructure (grain size and fraction of precipitates) and the respective thermo-mechanical properties (tensile properties, recovery and recrystallisation behaviour). In general, samples to be extruded were prepared according to the following technique:

An alloy sample was prepared by melting its components together in a steel crucible. The melt surface was protected by use of protective gas ($CO_2$+2% $SF_6$). The temperature was raised to 760-800° C. before the molten alloy was stirred to homogenise its melt chemistry. The molten alloy was then cast into a mould to achieve a billet of nominally 120 mm diameter and 300 mm length.

The billet was machined to nominally 75 mm diameter and 150-250 mm length in order to prepare the sample for extrusion.

Alternatively some samples were prepared for extrusion by casting as above but in a mould of nominally 300 mm in diameter. That larger billet was then extruded to bring its diameter down to 56 mm. In either case the billet thus formed was then homogenised, by heating to approximately 525° C. for 4-8 hours.

Extrusion was carried out on a hydraulic press. The product from the 75 mm billet was round bar section, with an available section of 3.2 to 25 mm diameter, but more typically 9.5 mm. The extruded section was used for evaluation.

Cast material was produced by melting in the same manner described previously, but here the molten alloy was poured into sand moulds to produce castings typically 200 mm*200 mm*25 mm with no subsequent extrusion or forging operations. For these samples, the material was heat treated at 525 C to solutionise its structure, cooled to room temperature (known as T4 treatment) and subsequently aged at 250 C for 16 hours. This material and total heat treatment is referred to herein as "Sand cast T6". It should be noted that, unlike the other samples, Sample 1a and Sample A additionally contain 0.13% Li.

Table 3 below, which is divided into sections a and b, summarises the chemical compositions, corrosion rates and room temperature tensile properties of the F condition extruded and the Sand cast T6 alloys tested. Samples 1a-1 h and Sample A are comparative examples of WE43 type alloys. Melts were produced to generate tensile data and for metallographic analysis. In the Table YS is the yield strength or yield point of the material and is the stress at which material strain changes from elastic deformation to plastic deformation, causing the sample to deform permanently. UTS means Ultimate Tensile Strength which is the maximum stress which the material could withstand before breaking. "Elong" stands for elongation at fracture. Table 3a sets out the data for the extruded samples whilst Table 3b shows the equivalent results for the cast samples.

As can be seen from the data of Tables 3a and 3b, the inventive changes in the composition of the alloys were not seriously detrimental to tensile properties in terms of strength, but in the case of ductility as measured by elongation, a noticeable improvement was observed where the HRE component of the alloys was rich in Gd and/or Dy and/or Er.

Referring to Table 3a Samples 1a-1 h demonstrate that for WE43 type alloys variations in known HRE content does not provide the improvement in tensile and corrosion properties in wrought material evidenced by the Samples 3a-3m of the present invention. Comparative Samples 2a-2i indicate how these improvement decline and disappear outside the limits of the present invention.

Table 3b shows similar results for cast material in which Samples A and C are WE43 type alloys and Samples B and D are within the present invention.

Table 4 sets out the estimated area and mean size data of particles found in a selection of alloys. The technique used was optical microscopy using commercially available software to analyse particle area and size by difference in colouration of particles. This technique does not give an absolute value, but does give a good estimation which was compared with physical measurement of random particles.

Table 4 clearly illustrates a reduction in the number of detectable particles in the alloys of this invention, which particles are likely to be brittle.

FIG. 2 shows microstructures of two comparative Samples 1a (FIG. 2A) and 1b (FIG. 2C) and two inventive samples 3d (FIG. 2B) and 3a (FIG. 2D) after extrusion at 450° C. For this metallographic examination of the as-extruded condition the materials were melted, cast, homogenized, cut to billets and extruded to bars. Then samples were cut, embedded in epoxy resin, ground, polished to a mirror like finish and etched with 2% Nital according to standard metallographic techniques [G Petzow, Metallographisches, keramographisches and plastographisches Ätzen, 2006].

As can be seen from FIG. 2B, the inventive magnesium alloy has significantly fewer precipitates and a slightly larger grain size after extrusion. Further investigation revealed that after several deformation steps and the respective intermediate heat treatments there were significantly fewer and smaller precipitates in sample 3d and that the grain size of sample 3d is still slightly larger than for comparative Sample 1a which was processed in exactly the same way.

In a preliminary test it was seen that the inventive magnesium alloys are less sensitive to temperature variations. In particular, the range between uniform elongation and elongation at fracture is more uniform compared to conventional magnesium alloys. The inventive alloys tested softened at a lower annealing temperature than conventional alloys and thus ductility was maintained at a more uniform level.

Beside the improvement of the mechanical properties and through this the improvement in processability, there was also found for the alloys of the present invention an improvement in the corrosion properties as presented in Tables 3a. For corrosion testing in the as-extruded condition the materials in Tables 3a were extruded to bars. Then samples were machined and tested in a 5% NaCl salt fog environment for 7 days in accordance with ASTM B117. Corrosion product was removed using a boiling solution of 10% chromium trioxide solution. The weight loss of the samples was determined and is expressed in mpy (mils penetration per year).

It can be seen that on average there is approximately a four fold improvement in salt fog corrosion performance between the inventive alloys tested and the comparative samples of WE43 type alloy.

The linkage between the improved processability and ductility of the magnesium alloys of the present invention over WE43 type alloys and their respective microstructures can be seen from a comparison of FIGS. 2A and 2C against FIGS. 2B and 2D. FIGS. 2A and 2C are micrographs showing the area percentage of clearly visible particles in samples of two of the WE43 type alloys whose analyses are set out in Table 3a. It will be noted that the area percentage is greater than 3%. The presence of such an amount of large particles has the effect of endowing those alloys with relatively poor ductility. By contrast FIGS. 2B and 2D show for samples of magnesium alloys of the present invention area percentages of the large particles less than 1.5%, which correlates with significantly improved ductility.

For the behaviour of sand cast material reference is made to Table 3b and to FIG. 4. Both alloys were produced in a similar manner, namely sand cast plates treated to the T4 condition, but it will be noted that the amount of brittle retained phase is significantly less in the inventive sample, D, than in the WE43 type alloy sample C.

TABLE 3A

| | Sample | Chemical Analysis wt % | | | | | | | | | | | | | | Corr[n] | Tensile Properties 0.2% YS | UTS | Elong |
|---|---|---|---|---|---|---|---|---|---|---|---|---|---|---|---|---|---|---|---|
| | No | Y | Nd | Zr | Gd | Dy | Yb | Er | Sm | La | Ce | Pr | Al | Fe | TRE[1] | Mpy[3] | Mpa | Mpa | % |
| WE 43 | 1a | 4.0 | 2.15 | 0.53 | 0.19 | 0.23 | 0.07 | 0.11 | 0.06 | 0.07 | 0.00 | 0.01 | 0.07 | 0.002 | ″0.74 | 40 | ND | ND | ND |
| type | 1b | 3.9 | 2.2 | 0.56 | 0.28 | 0.30 | 0.03 | 0.09 | 0.03 | 0.00 | 0.00 | 0.00 | 0.01 | 0.002 | ″0.73 | 56 | 209 | 298 | 19 |
| alloy[2] | 1c | 4.3 | 2.24 | 0.45 | 0.19 | 0.23 | 0.07 | 0.11 | 0.07 | 0.07 | 0.01 | 0.06 | 0.00 | 0.003 | ″0.81 | ND | 183 | 278 | 16 |
| | 1d | 4.0 | 2.26 | 0.50 | 0.16 | 0.20 | 0.06 | 0.11 | 0.06 | 0.07 | 0.78 | 0.00 | 0.01 | 0.003 | ″1.44 | ND | 191 | 283 | 19 |
| | 1e | 4.0 | 2.49 | 0.47 | 0.18 | 0.23 | 0.07 | 0.11 | 0.07 | 0.07 | 0.01 | 0.07 | 0.00 | 0.002 | ″0.81 | ND | 193 | 281 | 16 |
| | 1f | 3.7 | 2.14 | 0.47 | 0.29 | 0.32 | 0.04 | 0.08 | 0.05 | 0.05 | 0.01 | 0.06 | 0.00 | 0.003 | ″0.90 | ND | 179 | 271 | 19 |
| | 1g | 4.2 | 2.3 | 0.44 | 0.18 | 0.22 | 0.06 | 0.11 | 0.07 | 0.07 | 0.01 | 0.07 | 0.00 | 0.002 | ″0.79 | ND | 188 | 283 | 17 |
| | 1h | 4.0 | 2.18 | 0.47 | 0.18 | 0.22 | 0.06 | 0.11 | 0.06 | 0.07 | 0.01 | 0.06 | 0.00 | 0.003 | ″0.77 | ND | 190 | 282 | 17 |
| Outside | 2a | 4.0 | 2.3 | 0.53 | 5.90 | 0.01 | 0.00 | 0.02 | 0.04 | 0.00 | 0.00 | 0.00 | 0.01 | 0.002 | ″5.97 | 14 | 254 | 333 | 18 |
| of | 2b | 6.2 | 2.2 | 0.54 | 0.37 | 0.38 | 0.00 | 0.01 | 0.00 | 0.00 | 0.00 | 0.00 | 0.01 | 0.002 | ″0.76 | 24 | 231 | 323 | 20 |
| invention | 2c | 3.8 | 2.4 | 0.02 | 0.48 | 0.46 | 0.00 | 0.00 | 0.01 | 0.00 | 0.00 | 0.00 | 0.01 | 0.003 | ″0.95 | 48 | 154 | 257 | 24 |
| | 2d | 3.9 | 2.4 | 0.02 | 0.50 | 0.50 | 0.00 | 0.00 | 0.01 | 0.00 | 0.00 | 0.00 | 0.01 | 0.003 | ″1.01 | 18 | 192 | 273 | 23 |
| | 2e[4] | 4.1 | 2.38 | 0.01 | 0.49 | 0.48 | 0.00 | 0.00 | 0.02 | 0.00 | 0.00 | 0.00 | 0.01 | 0.01 | ″0.99 | 348 | 326 | 376 | 12 |
| | 2f[5] | 3.7 | 2.1 | 0.02 | 0.47 | 0.46 | 0.00 | 0.01 | 0.02 | 0.00 | 0.00 | 0.00 | 0.01 | 0.004 | ″0.96 | 315 | 202 | 283 | 24 |
| | 2g[6] | 4.5 | 4.45 | 0.61 | 0.81 | 0.00 | 0.00 | 0.00 | 0.00 | 0.00 | 0.00 | 0.00 | 0.01 | 0.002 | ″0.81 | 35 | 243 | 304 | 12 |
| | 2h | 8.0 | 9 | 0.02 | 1.05 | 0.98 | 0.00 | 0.00 | 0.01 | 0.03 | 0.00 | 0.14 | 0.01 | 0.0017 | ″2.21 | 8 | 262 | 329 | 2 |
| | 2i | 3.9 | 0.04 | 0.47 | 0.00 | 2.57 | 0.00 | 0.01 | 0.01 | 0.00 | 0.02 | 0.00 | 0.005 | 0.003 | ″2.61 | 11 | 150 | 244 | 24 |
| Within | 3a | 4.2 | 2.4 | 0.52 | 0.48 | 0.48 | 0.00 | 0.01 | 0.01 | 0.00 | 0.00 | 0.00 | 0.01 | 0.002 | ″0.98 | 12 | 202 | 290 | 25 |
| Patent | 3b | 3.9 | 2.2 | 0.59 | 0.48 | 0.49 | 0.00 | 0.01 | 0.00 | 0.00 | 0.00 | 0.00 | 0.01 | 0.002 | ″0.98 | 9 | 208 | 286 | 28 |
| Appli- | 3c | 4.0 | 2.1 | 0.63 | 0.38 | 0.43 | 0.00 | 0.01 | 0.00 | 0.00 | 0.00 | 0.00 | 0.01 | 0.003 | ″0.82 | 7 | 233 | 296 | 25 |
| cation | 3d | 4.1 | 2.32 | 0.55 | 0.65 | 0.00 | 0.00 | 0.01 | 0.00 | 0.00 | 0.01 | 0.00 | 0.01 | 0.002 | ″0.67 | 10 | 193 | 283 | 27 |
| | 3e | 3.8 | 2.2 | 0.58 | 0.00 | 0.54 | 0.00 | 0.01 | 0.00 | 0.00 | 0.00 | 0.00 | 0.01 | 0.002 | ″0.55 | 8 | 204 | 279 | 25 |
| | 3f | 4.3 | 2.3 | 0.55 | 0.54 | 0.00 | 0.00 | 0.01 | 0.00 | 0.00 | 0.00 | 0.00 | 0.01 | 0.002 | 0.55 | 8 | 212 | 292 | 24 |
| | 3g | 3.9 | 2.4 | 0.42 | 0.45 | 0.00 | 0.00 | 0.00 | 0.01 | 0.00 | 0.00 | 0.00 | 0.24 | 0.001 | 0.46 | 6 | 187 | 263 | 26 |
| | 3h | 4.2 | 2.3 | 0.52 | 1.53 | 1.50 | 0.00 | 0.01 | 0.02 | 0.00 | 0.00 | 0.00 | 0.01 | 0.002 | 3.06 | 13 | 223 | 307 | 24 |
| | 3i | 4.0 | 1.6 | 0.59 | 0.40 | 0.45 | 0.00 | 0.01 | 0.01 | 0.00 | 0.00 | 0.00 | 0.00 | 0.002 | 0.87 | 14 | 193 | 270 | 27 |
| | 3j | 3.6 | 2.0 | 0.6 | 0.43 | 0.46 | 0.00 | 0.01 | 0.01 | 0.00 | 0.00 | 0.00 | 0.00 | 0.003 | 0.87 | 10 | 198 | 276 | 28 |
| | 3k | 4.3 | 2.3 | 0.59 | 0.54 | 0.00 | 0.00 | 0.47 | 0.00 | 0.00 | 0.00 | 0.00 | 0.01 | 0.002 | 1.01 | 8 | 198 | 286 | 26 |
| | 3l | 4.0 | 2.4 | 0.60 | 0.00 | 0.00 | 0.00 | 1.74 | 0.00 | 0.000 | 0.00 | 0.00 | 0.01 | 0.002 | 1.74 | 15 | 217 | 294 | 23 |
| | 3m | 3.9 | 0.07 | 0.46 | 2.80 | 0.00 | 0.00 | 0.01 | 0.02 | 0.00 | 0.04 | 0.00 | 0.008 | 0.003 | 2.87 | 11 | 152 | 250 | 25 |

Table 3A continued - Explanatory Notes

Note [1]TRE—Total Rare Earths (RE & HRE) shown ie Gd, Dy, Yb, Er, Sm, La, Ce, Pr Note [2]Additional other HRE also present in these examples, ranging from 10-30% of the sum of Gd, Dy, Yb, Er, Sm Note [3]Corrosion in salt fog in accordance with ASTM B117

Note [4]Contains 2.1% Zn & 1.34% Mn

Note [5]Contains 0.46% Mn

Note [6]Contains 0.02% Mn and 0.17% Zn

TABLE 3b

| Sample | Chemical Analysis wt % | | | | | | | | | | | | | | Tensile Properties 0.2% YS | UTS | |
|---|---|---|---|---|---|---|---|---|---|---|---|---|---|---|---|---|---|
| No | Y | Nd | Zr | Gd | Dy | Yb | Er | Sm | La | Ce | Pr | Al | Fe | TRE[1] | Mpa | Mpa | Elong % |
| A[3] | 4.3 | 2.3 | 0.59 | 0.61 | 0.62 | 0.01 | 0.03 | 0.02 | 0.01 | 0.00 | 0.06 | 0.01 | 0.003 | 1.36[2] | 215 | 274 | 3 |
| B | 4.3 | 2.4 | 0.58 | 0.51 | 0.59 | 0.00 | 0.01 | 0.01 | 0.00 | 0.00 | 0.06 | 0.01 | 0.002 | 1.18 | 213 | 297 | 6 |
| C[4] | 3.8 | 2.2 | 0.64 | 0.25 | 0.24 | 0.08 | 0.12 | 0.06 | 0.09 | 0.00 | 0.00 | 0.01 | 0.002 | 0.84 | — | — | — |
| D | 4.0 | 2.3 | 0.64 | 0.44 | 0.44 | 0.00 | 0.13 | 0.01 | 0.00 | 0.00 | 0.00 | 0.01 | 0.002 | 1.02 | — | — | — |

Note [1]TRE—Total Rare Earths (RE & HRE) shown ie Gd, Dy, Yb, Er, Sm, La, Ce, Pr Note [2]Additional other HRE also present ranging from 10-30% of the sum of Gd, Dy, Yb, Er, Sm Note [3]WE43 type alloy - not of the invention Note [4]Not of the invention

TABLE 4

| Sample no | | Area of particles as percentage of matrix (%) | Mean Diameter (microns) |
|---|---|---|---|
| WE type Alloy | | | |
| " | 1a | 5.8 | 4.3 |
| " | 1b | 3.5 | 2.6 |
| Outside invention | | | |
| " | 2c | 5.3 | 2.4 |
| " | 2g | 21.8 | 3.6 |
| Within invention | | | |
| " | 3a | 1.1 | 6.9 |
| " | 3d | 0.7 | 2.4 |
| " | 3e | 1.7 | 2.6 |
| " | 3f | 1.5 | 3 |
| " | 3h | 1.1 | 1.2 |
| " | 3k | 0.5 | 1.2 |
| " | 3l | 2.5 | 3.7 |
| " | 3m | <0.5 | 0.8 |

The invention claimed is:

1. A magnesium alloy suitable for use as a wrought alloy containing:

Y: 2.0-6.0% by weight
Nd: 0.05-2.5% by weight
Gd: 0 to <0.6% by weight
Dy: 0 to <0.6% by weight
Er: 0 to <0.6% by weight
Zr: 0.05-1.0% by weight
Zn+Mn: <0.11% by weight
Yb: 0-0.02% by weight
Sm: 0-0.04% by weight
Al: <0.3% by weight
Li: <0.2% by weight,
each of Ce, La, Zn, Fe, Si, Cu, Ag and Cd individually: 0-0.06% by weight,
Ni: 0-0.003% by weight,
optionally rare earths and heavy rare earths other than Y, Nd, Gd, Dy, Er, Yb and Sm in a total amount of up to 0.5% by weight,
the balance being magnesium and incidental impurities up to a total of 0.3% by weight,
wherein the total content of Gd, Dy and Er is in the range of 0.3 to <0.6% by weight.

2. An alloy as claimed in claim 1 wherein the area percentage of any precipitated particles formed during processing of the alloy having an average particle size of between 1 and 15 μm is less than 3%.

3. An alloy as claimed in claim 2 where the said particles are rich in Nd, such that the particles have a percentage composition of Nd greater than the percentage composition of any other element in the particle.

4. An alloy as claimed in claim 1 having a 0.2% YS>150 MPa.

5. An alloy as claimed in claim 1 wherein Yb is present in an amount of less than 0.01% by weight.

6. An alloy as claimed in claim 1 wherein the content of Y is 3.5-4.5% by weight.

7. An alloy as claimed in claim 6 wherein the content of Y is 3.7-4.3% by weight.

8. An alloy as claimed in claim 1 wherein the content of Nd is 1.5-2.5% by weight.

9. An alloy as claimed in claim 8 wherein the content of Nd is 2.0-2.5% by weight.

10. An alloy as claimed in claim 1 wherein the content of Zr is 0.1-0.7% by weight.

11. An alloy as claimed in claim 1 wherein the total content of Gd, Dy and Er is in the range of 0.5 to <0.6% by weight.

12. An alloy as claimed in claim 1 wherein the total content of rare earths (excluding Y and Nd) other than Gd, Dy and Er is less than 13% of the total weight of Gd, Dy and Er.

13. An alloy as claimed in claim 1, wherein Sm is present in an amount of less than 0.02% by weight.

14. An alloy as claimed in claim 1 having a magnesium content of at least 91% by weight.

15. An alloy as claimed in claim 2 wherein when the alloy is in the T4 or T6 condition the area percentage of any precipitated particles having an average size greater than 1 μm and less than 15 μm is less than 1.5%.

16. An alloy as claimed in claim 15 wherein when the alloy is in the T4 or T6 condition the area percentage of particles having an average size greater than 1 μm and less than 7 μm is less than 3%.

17. An alloy as claimed in claim 1 wherein the alloy exhibits a corrosion rate as measured by a salt fog test of less than 40 Mpy.

18. An alloy as claimed in claim 17 wherein the alloy exhibits a corrosion rate as measured by a salt fog test of less than 30 Mpy.

19. An alloy as claimed in claim 1 when heat treated and/or wrought and/or used as a base alloy for a metal matrix composite.

20. An alloy as claimed in claim 1 wherein the alloy exhibits a corrosion rate as measured by a salt fog test of less than 56 Mpy.

* * * * *